US008733498B2

(12) United States Patent
Spieth

(10) Patent No.: US 8,733,498 B2
(45) Date of Patent: May 27, 2014

(54) HOUSING

(75) Inventor: Arnulf Spieth, Hochdorf (DE)

(73) Assignee: J. Eberspaecher GmbH & Co. KG, Esslingen (DE)

( * ) Notice: Subject to any disclaimer, the term of this patent is extended or adjusted under 35 U.S.C. 154(b) by 93 days.

(21) Appl. No.: 13/312,313

(22) Filed: Dec. 6, 2011

(65) Prior Publication Data

US 2012/0138382 A1 Jun. 7, 2012

(30) Foreign Application Priority Data

Dec. 7, 2010 (DE) ..... 10 2010 062 569

(51) Int. Cl.
*F01N 13/18* (2010.01)
*F01N 13/08* (2010.01)
*F01N 5/00* (2006.01)

(52) U.S. Cl.
USPC ..... 181/282; 181/212; 181/228

(58) Field of Classification Search
USPC ..... 181/282, 212, 228; 29/428
See application file for complete search history.

(56) References Cited

U.S. PATENT DOCUMENTS

| | | | | |
|---|---|---|---|---|
| 1,447,380 | A * | 3/1923 | Goetz | 181/236 |
| 2,151,084 | A * | 3/1939 | Deremer | 181/282 |
| 3,018,841 | A * | 1/1962 | Gerlich | 181/258 |
| 8,292,026 | B2 * | 10/2012 | Tauschek et al. | 181/251 |
| 2006/0027420 | A1 * | 2/2006 | Hahnl et al. | 181/283 |
| 2007/0080020 | A1 * | 4/2007 | Emmett | 181/237 |
| 2010/0126159 | A1 * | 5/2010 | Han et al. | 60/324 |
| 2011/0272209 | A1 * | 11/2011 | Tauschek et al. | 181/228 |
| 2012/0223210 | A1 * | 9/2012 | Spieth et al. | 248/575 |
| 2012/0273296 | A1 * | 11/2012 | Nording et al. | 181/198 |

FOREIGN PATENT DOCUMENTS

| | | | | |
|---|---|---|---|---|
| DE | 35 14 475 | A1 | 10/1986 | |
| DE | 3704006 | A1 * | 8/1988 | G10K 11/16 |
| DE | 19849118 | A1 | 4/2000 | |
| DE | 10 2004 042 110 | B3 | 9/2005 | |
| GB | 623098 | | 5/1949 | |
| WO | WO 98/53187 | A1 | 11/1998 | |
| WO | WO 2004/027231 | A2 | 4/2004 | |

* cited by examiner

*Primary Examiner* — David Warren
*Assistant Examiner* — Christina Russell
(74) *Attorney, Agent, or Firm* — Reinhart Boerner Van Deuren P.C.

(57) ABSTRACT

The present invention relates to a housing (1) with a jacket (2), enclosing a housing interior space (7) in circumferential direction (8). For reducing self-induced vibrations of the jacket (2), at least one preloading device (14) is proposed, which is arranged in the housing interior space (7), which supports itself on a first supporting region (15) of the jacket (2) on the inside of the jacket (2) subject to a first preload (16) orientated towards the outside and which supports itself on a second supporting region (17) of the jacket (2) spaced from the first supporting region (15) on the jacket (2) on the inside subject to a second preload (18) orientated towards the outside.

8 Claims, 5 Drawing Sheets

HOUSING

CROSS-REFERENCE TO RELATED PATENT APPLICATIONS

This patent application claims priority to German Application No. 102010062569.8, filed Dec. 7, 2010, the entire teachings and disclosure of which are incorporated herein by reference thereto.

FIELD OF THE INVENTION

The present invention relates to a housing, such as can be used for example with a component of an exhaust system of a combustion engine, particularly of a motor vehicle. For example, it can be the housing of a silencer.

BACKGROUND OF THE INVENTION

Such a housing can be designed cylindrically and usually comprises a jacket, which encloses a housing interior space in circumferential direction. In principle, two end bottoms can be provided, which axially close off the housing interior space and which are connected to the jacket in a fixed manner. Here, the housing can be embodied in wrap design, wherein a one-part jacket is wrapped in the circumferential direction and the joint ends are fastened to one another. Alternatively, the housing can be produced in half-shell design, wherein two half shells in each case surround the two end bottoms and the housing interior space in the circumferential direction by approximately 180° and which are fastened to each other in a separating plane in the region of their ends. A half-shell design is also conceivable, wherein the half-shells axially limit the housing interior space, so that no end bottoms are present. A tubular design is likewise possible, wherein a tubular body is used as jacket.

Particularly with vehicle applications, the housing can be excited into vibrations and oscillations, for example a vibration excitation can be effected through the road or through the engine or through gas pulsations in the exhaust system. It has been shown that particularly in the region of the jacket, self-induced vibrations can be generated which result in an undesirable sound emission. Added to this is that especially in the vehicle sector, attempts are made to save weight in order to reduce the energy consumption of the vehicles. In the case of housings, particularly of components of exhaust systems, this results in that for the sheets used reduced wall thicknesses are selected. Here it has been shown that reduced wall thicknesses particularly in the region of the jacket increase the tendency towards self-induced vibrations of the jacket.

The present invention deals with the problem of stating an improved embodiment for a housing of the type mentioned at the outset, particularly for a silencer housing, which is particularly characterized in that a tendency towards self-induced vibrations in the region of the jacket is reduced even with a thin wall thickness.

SUMMARY OF THE INVENTION

According to the invention, this problem is solved through the subject of the independent claim, advantageous embodiments are the subject of the dependent claims.

The invention is based on the general idea of equipping the housing with at least one preloading device which is located in the housing interior space, i.e. arranged within the jacket and which on at least one supporting region of the jacket introduces into the jacket a preload or supporting force orientated towards the outside. Through this preloaded supporting of the jacket its self-induced vibration behavior changes significantly, so that the tendency towards undesirable self-induced vibrations can be substantially reduced. Because of this it is possible to reduce the wall thickness of the sheet used for producing the jacket without creating an undesirably high sound emission in the process.

Practically, the respective preloading device is designed in this case so that it is supported on a first supporting region of the jacket inside on the jacket and supports a first supporting force orientated towards the inside and supports itself on a second supporting region of the jacket spaced from the first supporting region on the inside on the jacket and introduces a second supporting force orientated towards the outside into the jacket. This second supporting force in this case can be greater than the first supporting force. In principle, a design is also conceivable, wherein the preloading forces are identical in size. In other words, the respective preloading device supports itself on the jacket in two supporting regions spaced from each other with a first preload and with a second preload. These preloads can be different in size, wherein preferentially the first preloading force is smaller than the second preloading force. The preloading device absorbs a first force or preload in the supporting region, transmitting it to the second supporting region in the form of a second force or preload.

Here, the invention utilizes the realization that in the case of a housing having an intermediate bottom arranged in the housing interior space the jacket is subjected to an inhomogeneous radial support in the circumferential direction as soon as the housing in longitudinal section has a round cross section that deviates from a circular cross section and is for example oval or elliptical. The preloads, particularly the preloads of different magnitudes, can be selected and positioned for stiffness the jacket so that vibration-threatened regions of the jacket are specifically supported.

With an advantageous embodiment it can be provided that the housing is designed cylindrically and comprises two end bottoms, which axially close off the housing interior space and are connected to the jacket in a fixed manner. The preloading device is then practically arranged between the end bottoms. Alternatively it can be provided that the housing has two half-shells which limit the housing interior space in circumferential direction and axially.

According to another advantageous embodiment, the two supporting regions can be spaced from each other in the circumferential direction. Here, the two supporting regions can more preferably lie in the same axial plane of the jacket. Alternatively, the two supporting regions can be spaced from each other in the axial direction. Because of this it is possible to support particularly vibration-threatened regions of the jacket.

According to an advantageous embodiment, the housing interior space can have a round, flattened cross section transversely to the axial direction so that a curvature radius of the jacket varies in the circumferential direction. For example, the cross section is elliptical or oval. Practically, the two supporting regions can now be arranged in circumferential regions with different curvature radii. This embodiment is based on the realization that the curvature radius has an effect on the stiffness of the respective jacket region and thus an effect on the vibration tendency of the respective jacket region. In particular, regions with smaller curvature radius are less vibration-threatened than regions with larger curvature radius.

Practically, the second supporting region, which in particular generates the greater second preload, can now be arranged in a circumferential region which has a smaller curvature radius than a circumferential region in which the first supporting region, which generates the smaller first preload, is arranged. In particular, the two supporting regions can be spaced from each other in the circumferential direction by at least 30° and a maximum of 90° and preferentially by approximately 45° from each other.

With another embodiment, the respective preloading device can be arranged on an end bottom or on an intermediate bottom. It is likewise possible to arrange a preloading structure in the housing interior space, which comprises the respective preloading device. Such an end bottom forms an axial limitation of the housing interior space. In contrast with this, such an intermediate bottom is arranged within the housing interior space, particularly axially between the two end bottoms, provided the housing has two end bottoms.

It is particularly advantageous if the respective preloading device comprises at least one lever having two supporting contours spaced from each other, each of which supports itself on the inside on the jacket in one of the supporting regions. Furthermore, the respective lever is pivotably arranged, so that it has a spatially fixed rotary axis, which can be positioned between the two supporting contours with respect to the lever, particularly so that lever arms that are different in size are obtained for the supporting structures. Since the torques on the lever have to cancel each other out, the lever arms that are different in size generate the desired preloads that are different in size in the two supporting contours.

Said lever thus comprises a first lever arm, which is assigned to the first supporting contour and thus to the first supporting region and a second lever arm, which is assigned to the second supporting contour and thus to the second supporting region, wherein the first lever arm in particular can be greater than the second lever arm, so that the first preload is smaller than the second preload, when the lever in the assembled state is not moved and thus a torque equilibrium prevails.

Practically, the respective lever can be pivotably arranged about said rotary axis on an end bottom or on an intermediate bottom or on a preloading structure arranged in the housing interior space. Here, the respective lever can be mounted rotatably adjustable about the rotary axis or in a manner capable of rolling about the rotary axis.

According to another advantageous embodiment, at least one of the support contours of the respective lever can be formed on a support body, which is moveably arranged on the respective lever. Through the use of such a support body an improved supporting effect can be achieved. In particular, the jacket can be supported or stabilized over a larger area, which significantly reduces the vibration capability of the jacket in this supporting region.

Preferentially, the same support body can be preloaded against the jacket via a plurality of levers, as a result of which greater supporting forces can be realized. In particular, the support body can have a convex outer contour facing the jacket, which is shaped complementarily to the concave inner contour of the respective supporting region of the jacket. Because of this, a secure support between support body and jacket is obtained, which in particular prevents relative movements between support body and jacket.

The jacket can be configured in wrap design or in tubular design or however in half-shell design. In the case of half-shell design, the second supporting region can be arranged proximally to a separating plane, in which the two half-shells are fastened to each other, while the first supporting region is then arranged distally to the separating plane. This design is based on the consideration that the jacket half-shells in the region of the separating plane have a greater stiffness than spaced from the separating plane, so that the stiffness is particularly effective distally to the separating plane.

As already explained on the outset, the housing is preferably a silencer housing, i.e. the housing of a silencer of an exhaust system of a combustion engine, particularly of a motor vehicle.

Further important features and advantages of the invention are obtained from the subclaims, from the drawings and from the associated Figure description by means of the drawings.

It is to be understood that the features mentioned above and still to be explained in the following cannot only be used in the respective combination stated, but also in other combinations or by themselves without leaving the scope of the present invention.

BRIEF DESCRIPTION OF THE DRAWINGS

Preferred exemplary embodiments of the invention are shown in the drawings and are explained in more detail in the following description, wherein safe reference characters refer to same or similar of functionally same components.

It shows, in each case schematically.

DETAILED DESCRIPTION OF THE INVENTION

Figure 1:
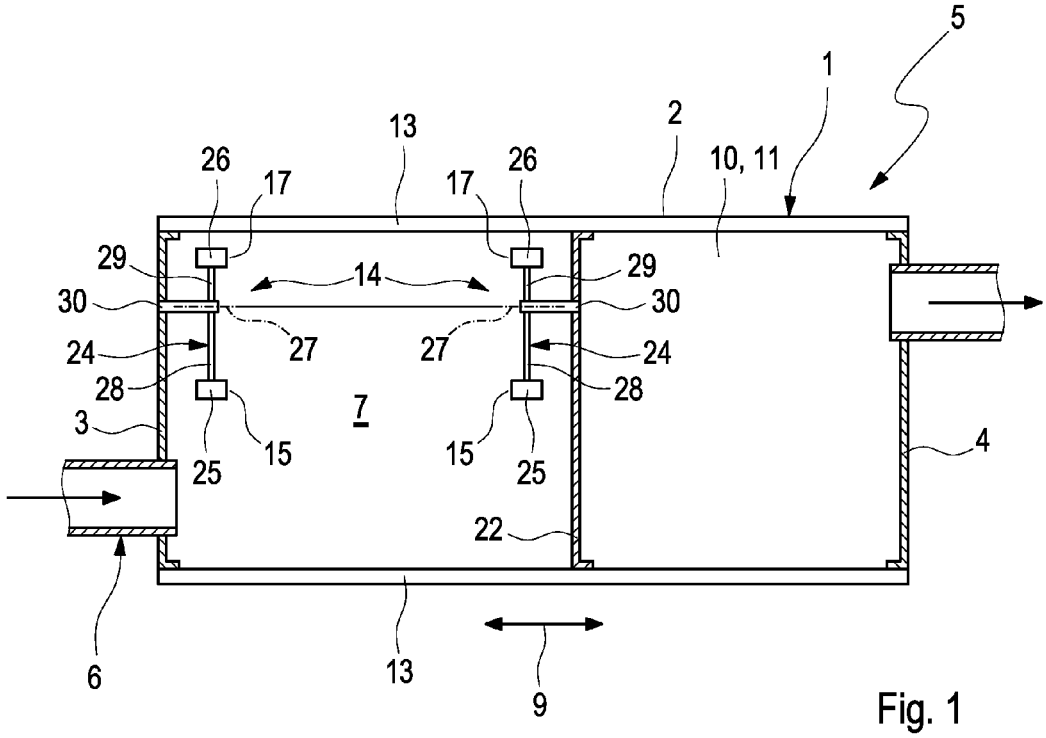
FIG. 1 is a greatly simplified longitudinal section through a housing.

According to FIGS. 1 to 8, a cylindrical housing 1 comprises a jacket 2 and two end bottoms 3, 4. The housing 1 is preferentially the housing 1 of a silencer 5 of an exhaust system 6 only shown in the region of the silencer 5, which can be used with a combustion engine, particularly of a motor vehicle, for discharging exhaust gases.

The jacket 2 encloses a housing interior space 7 in a circumferential direction 8 indicated by a double arrow. The end bottoms 3, 4 close off the housing interior space 7 in an axial direction 9 indicated by a double arrow in FIG. 1. Here, the end bottoms 3, 4 form the axial end faces or ends of the housing 1. The end bottoms 3, 4 are connected to the jacket 2 in a fixed manner. With another embodiment, the jacket 2 can also be shaped so that it assumes the function of the end bottoms 4, 5, namely the axial limitation of the housing interior space 7.

In the case of the embodiments shown here, the jacket 2 is realized in half-shell design, so that it comprises two half-shells 10, 11 which bear against each other or are fastened to each other in a separating plane 12. In particular, the two half-shells 10, 11 can have collars 13 standing away transversely to the longitudinal direction 9, via which the half-shells 10, 11 bear against each other in the separating plane 12 and via which the half-shells 10, 11 can be fastened to each other. The longitudinal section of the housing 1 shown in FIG. 1 in this case passes through the separating plane 12 so that only one of the half-shells 10, 11 is visible. With the other embodiment mentioned above the half-shells 10, 11 can be shaped so that they integrally include the two end bottoms 4, 5 so that separate end bottoms can be omitted.

Alternatively to the half-shell design, the jacket 2 can also be configured in wrap design or in tubular design. The following explanations apply not only to the half-design shown but analogously also to the tubular design or to the wrap design or to any other suitable design for the housing 1 or the jacket 2.

The housing 1 additionally comprises at least one preloading device 14, which is arranged axially between the end bottoms 3, 4 in the housing interior space 7. In the example of FIG. 1, two such preloading devices 14 are shown. In FIGS. 2 to 8 by contrast, only a single preloading device 14 is shown.

The respective preloading device 14 supports itself on a first supporting region 15 of the jacket 2 inside on the jacket 2 subject to a first preload 16 orientated towards the outside and indicated by an arrow. Furthermore, the preloading device 14 supports itself on a second supporting region 17 of the jacket 2 inside on the jacket 2 subject to a second preload 18 orientated towards the outside and likewise indicated by an arrow. Here, the second preload 18 is preferentially greater than the first preload 16. The two supporting regions 15, 17 are positioned spaced from each other on the jacket 2. Practically, the two supporting regions 15, 17 are spaced from each other in the circumferential direction 8. Here, they can basically lie in the same axial plane of the jacket 2.

With an alternative embodiment, the two supporting regions 15, 17 can be arranged spaced from each other in axial direction 9. Here, they can be located in the same circumferential section, i.e. axially orientated aligned with each other. In principle, they can also be spaced from each other in the circumferential direction 8.

In the case of the preferred embodiments shown here, the housing 2 or its housing interior space 7 has a round but not circular but flattened cross section transversely to the axial direction 9, which can more preferably be oval or elliptical. Here, a curvature radius 19 of the jacket 2 in particular can vary in the circumferential direction 8. The two supporting regions 15, 17 are then practically located in circumferential regions 20, 21 which have different curvature radii 19. It can be more preferably provided here that the first supporting region 15 is arranged in a first circumferential region 20, which has a larger curvature radius 19 than a second circumferential region 21, in which the second supporting region 17 is arranged. In other words, the second supporting region 17 assigned to the larger second preload 18 is located in the circumferential region 21 with smaller curvature radius 19. The smaller the curvature radius 19, the sturdier is the jacket 2, the greater are the forces that can be supported on the jacket 2 without harmful deformation.

Practically, the two supporting regions 15, 17 are spaced from each other in the circumferential direction 8 by at least 30° and at by a maximum of 90°. In the case of the shown examples, the two supporting regions 15, 17 are each spaced from each other by approximately 45° in the circumferential direction.

As can be seen in FIGS. 2 to 8, the first supporting region 15 in the case of the jacket 2 configured in half-shell design in this case is arranged distally to the separating plane 2, while the second supporting region 17 is arranged proximally to the separating plane 12.

Figure 3:
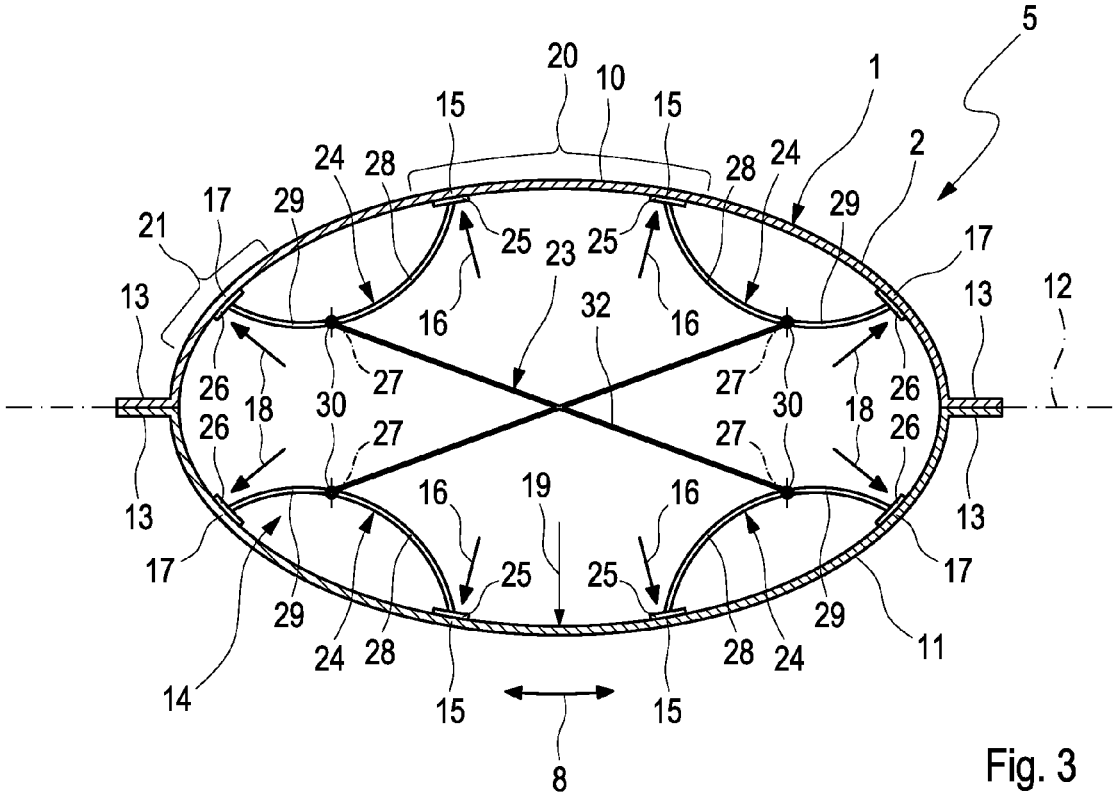

According to FIG. 1, the preloading device 14 shown on the left is arranged on one of the end bottoms 3, 4. In contrast with this, the preloading device 14 shown in FIG. 1 on the right is arranged on an intermediate bottom 22, which is axially arranged between the two end bottoms 3, 4. In contrast with this, FIG. 3 shows an embodiment wherein the respective preloading device 14 has a pre-structure 23, which can manage without bottom and can be arranged axially between the end bottoms 3, 4 in the housing interior space 7.

Figure 2:
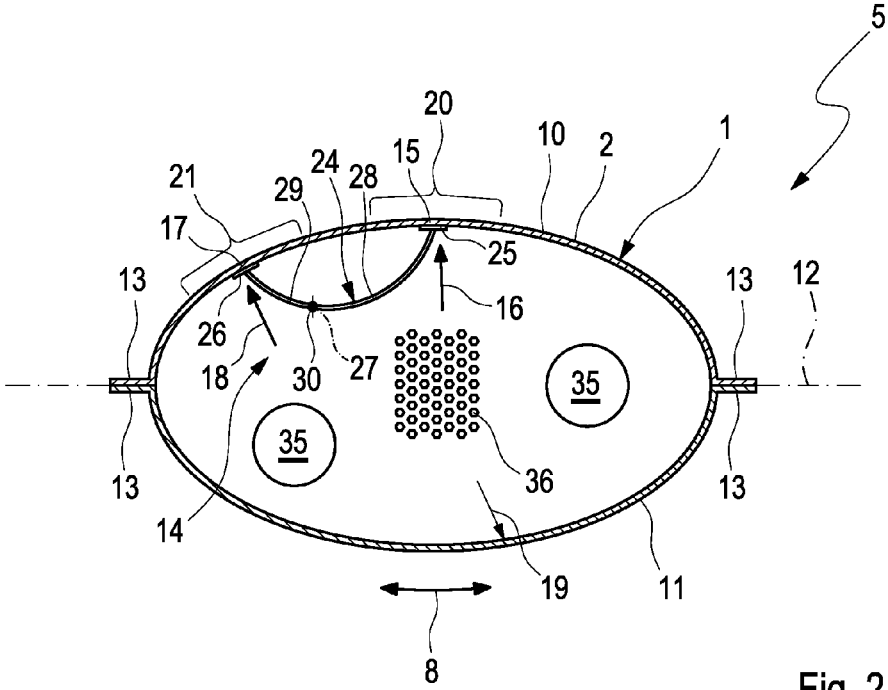
FIGS. 2 to 7 show a cross section each through the housing, however with different embodiments.

According to FIG. 2, said intermediate bottom 22 can for example comprise at least one passage opening 35 and/or at least one perforation 36.

Preferentially, the respective preloading device 14 comprises at least one lever 24 only shown in a simplified manner here, which comprises two supporting contours spaced from each other, namely a first supporting contour 25 and a second supporting contour 26, which are arranged spaced from each other on the respective lever 24. In particular, the two supporting contours 25, 26 are located on the ends of the respective lever 24 which are distant from each other. The first supporting contour 25 supports itself on the inside on the jacket 2 in the first supporting region 15. The second supporting contour 26 supports itself on the inside on the jacket 2 in the second supporting region 17. The lever 24 is assigned a rotary axis 27, about which the lever 24 is moveable. The rotary axis 27 is largely position-fixed or spatially fixed within the housing 1. The rotary axis 27 is arranged on the lever 24 between the supporting contours 25, 26, namely asymmetrically, so that on the lever 24 two lever arms that are different in size form for the two supporting contours 25, 26, namely a first lever arm 28, which leads from the rotary axis 27 to the first supporting contour 25, and a second lever arm 29, which leads from the rotary axis 27 to the second supporting contour 26. Noticeably, the first lever arm 28 is greater than the second lever arm 29. Since the lever 27 in the assembled state of the housing 2 rests immovably, the torques acting on the lever 24 are identical in size or in equilibrium. Consequently, the second preload 18 introduced on the shorter second lever arm 29 into the second supporting region 17 is greater than the first preload 16 introduced into the first supporting region 15 via the greater first lever arm 28.

The mentioned lever arms 28, 29 are to be understood with respect to their effective lever arm length, i.e. with respect to their physical or mathematical lever arm length.

According to FIGS. 1, 2 and 5 to 8, the respective lever 24 can be pivotably arranged about the rotary axis 27 on one of the end bottoms 3, 4 or on such an intermediate bottom 22 in that it is mounted in a rotationally adjustable manner about the rotary axis 27 on the respective bottom 3, 4, 22. A corresponding rotary bearing 30 is shown in the Figures in a simplified manner. With this embodiment, the space position of the rotary axis 27 is fixed.

Figure 4:
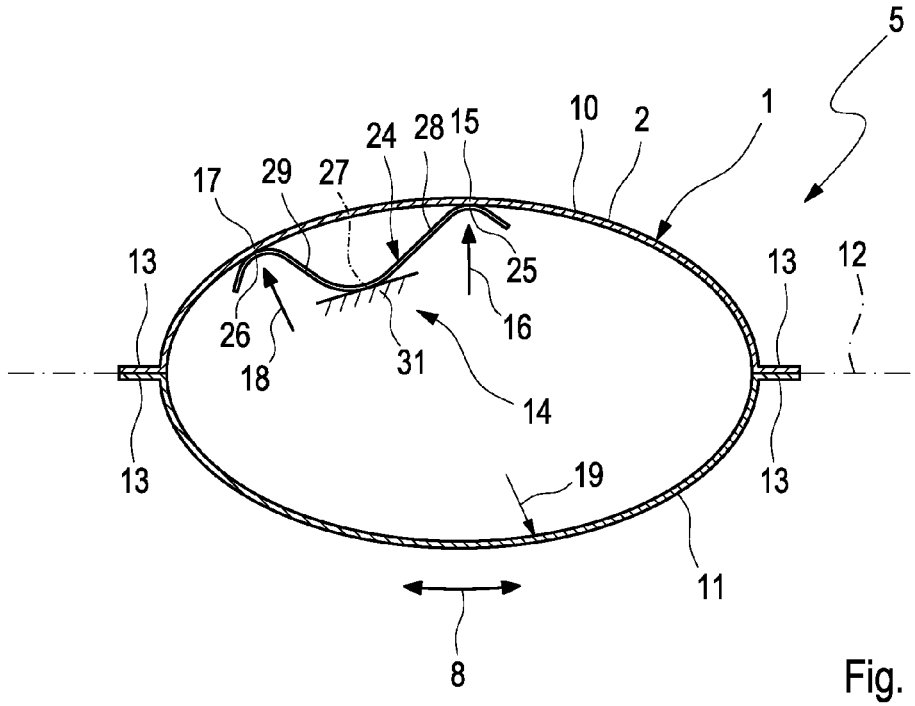

Alternatively, the pivotability of the lever 24 about the rotary axis 27 according to FIG. 4 can also be realized in that the respective lever 24 is arranged in the region of the rotary axis 27 so that it can roll off the respective bottom 3, 4, 22. In FIG. 4, a rolling-off contour 31 suitable for this purpose is shown in a simplified manner. With this embodiment, the space position of the rotary axis 27 can change slightly through the rolling-off movement, so that in this case it is only substantially fixed.

With the embodiment shown in FIG. 3, the preloading device 14 as already mentioned comprises a preloading structure 23, which is located axially between the end bottoms 3, 4. In the example of FIG. 3, this preloading structure 23 comprises a plurality of levers 24, namely purely exemplarily and without restriction of the generality, exactly four such levers 24, which are arranged distributed in the circumferential direction 8. Each lever 24 supports itself on a first supporting region 15 and on a second supporting region 17 on the jacket 2 from the inside. Accordingly, four first supporting regions 15 and four second supporting regions 17 distributed in the circumferential direction 8 on the jacket 2 are formed here. The supporting structure 23 can have a comparatively stiff carrier 32, on which the individual levers 24 are arranged, wherein the pivotability of the respective lever 24 about the associated rotary axis 27 can be realized through the elasticity of the carrier 32 or through corresponding bearing locations.

Figure 5:
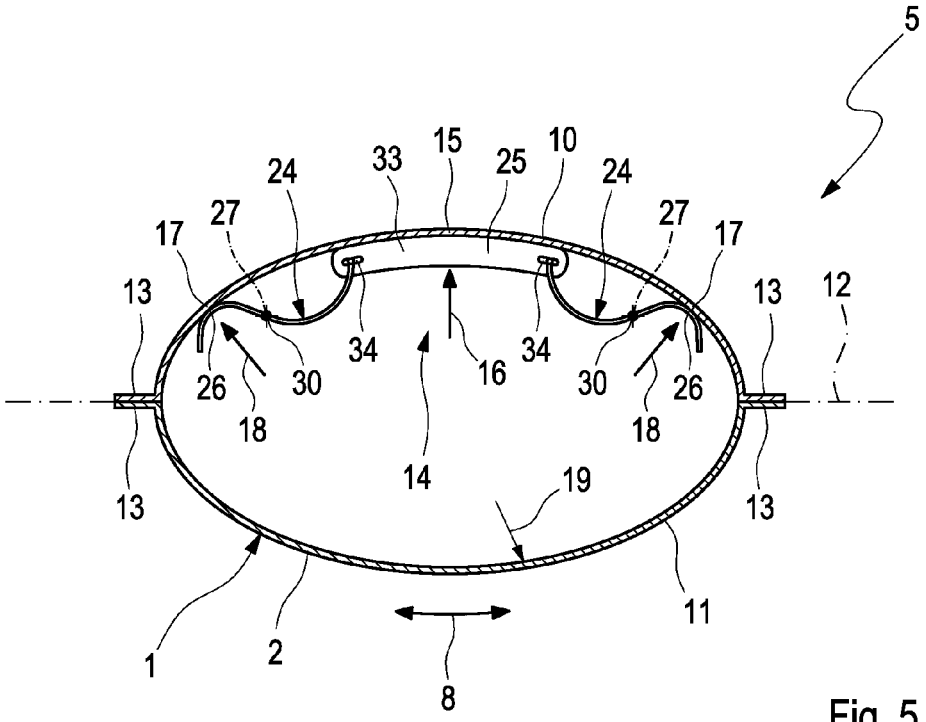
Figure 7:
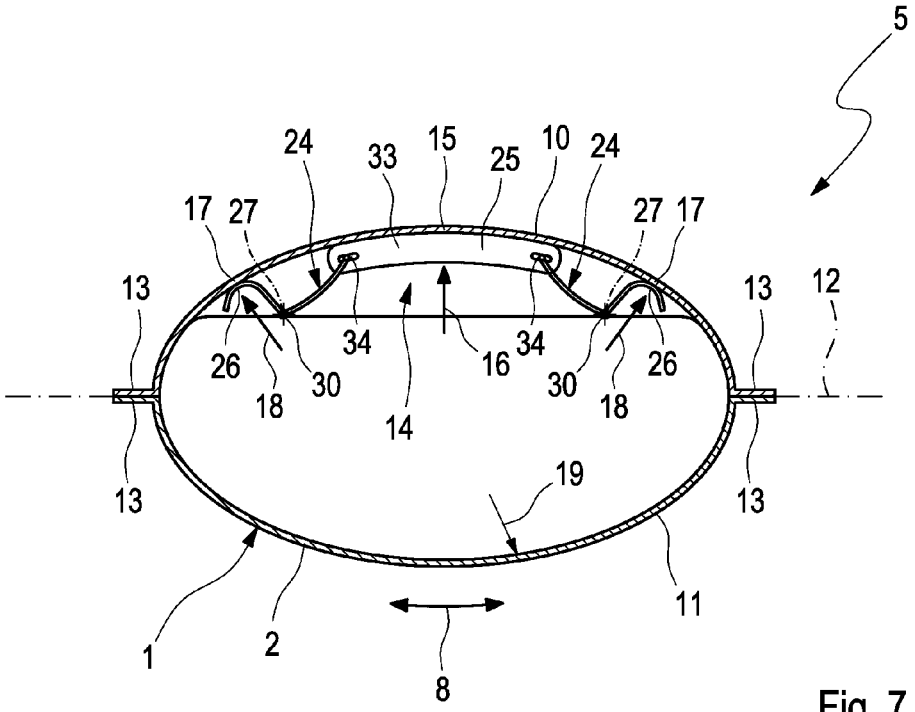

With the embodiments of FIGS. 5 and 7, the respective preloading device 14 comprises a support body 33, on which one of the supporting contours 15, 17, in this case the first supporting contour 15 is formed. This support body 33 in this case is moveably arranged on at least one such lever 24. In the examples of FIGS. 5 and 7, an elongated hole 34 each is provided for the moveable coupling between support body 33 and respective lever 24, which makes possible a relative movement between support body 33 and associated lever 24. Furthermore, with the examples of FIGS. 5 and 7 shown here, the same support body 33 is simultaneously preloaded against the jacket 2 via a plurality of levers 24, namely for example via two levers 24. Furthermore, the respective support body 33 practically has a convex outer contour facing the jacket 2, which is shaped complementarily to the concave inner contour of the respective supporting region 15, 17, in this case the first supporting region 15 of the jacket 2. Thus, a large-area and sturdy support for the support body 33 on the jacket 2 is obtained.

Figure 6:
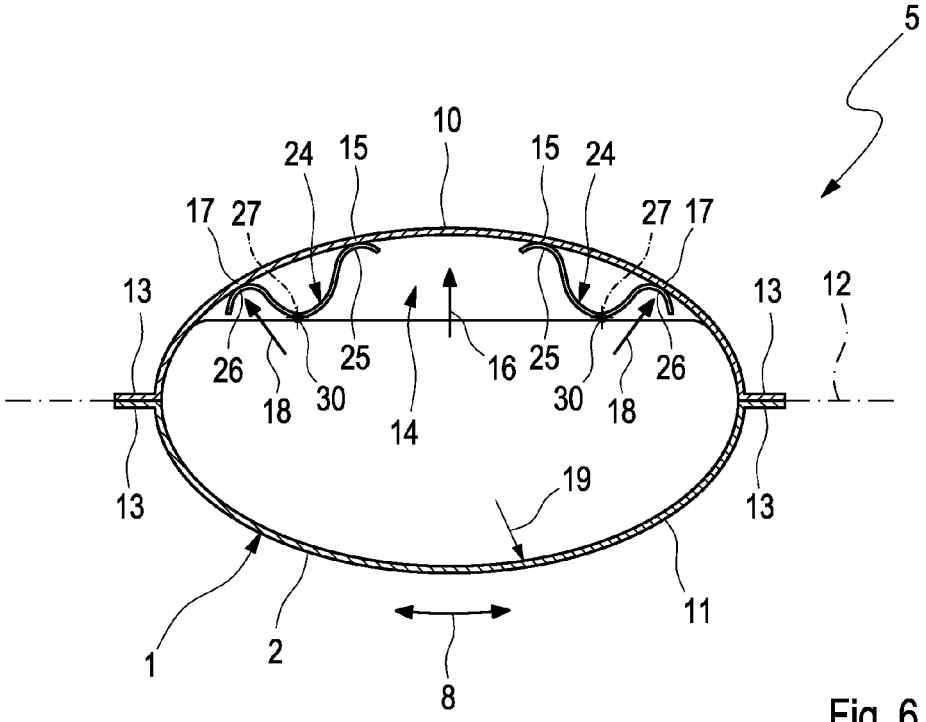

In FIGS. 1 to 5 and 8, the levers 24 are each axially attached to the respective bottom 3, 4, 22 at a suitable point of the respective bottom 3, 4, 22. In contrast with this, FIGS. 6 and 7 show embodiments, wherein the levers 24 are attached to the intermediate bottoms 22 on the edge so that the levers 24 in the assembled state are located radially between the intermediate bottom 22 and the jacket 2.

Figure 8A:
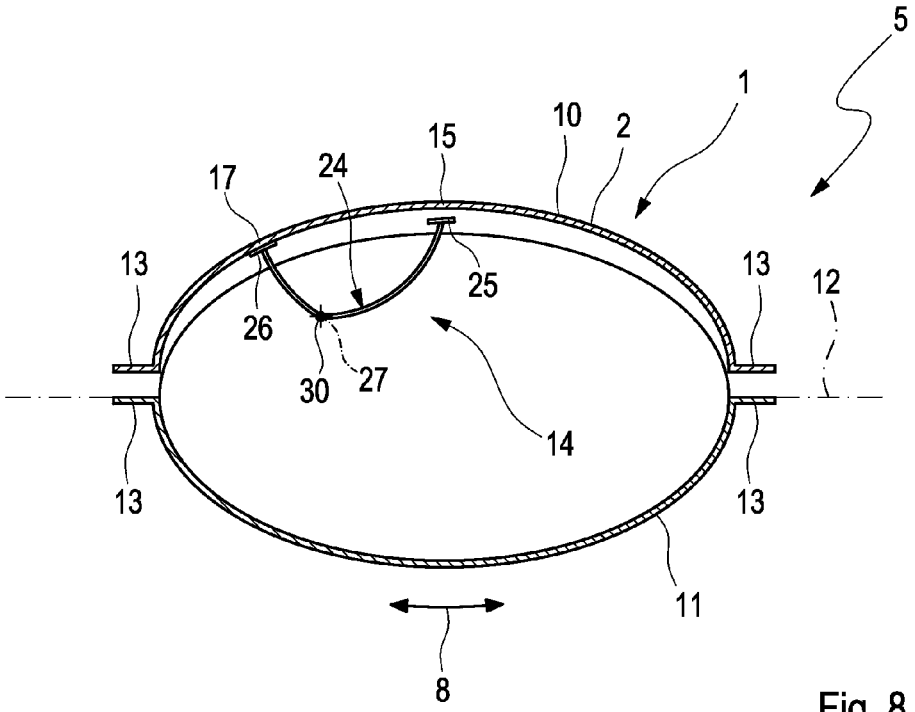
FIG. 8 is a cross section of the housing with different assembly states a and b.
Figure 8B:
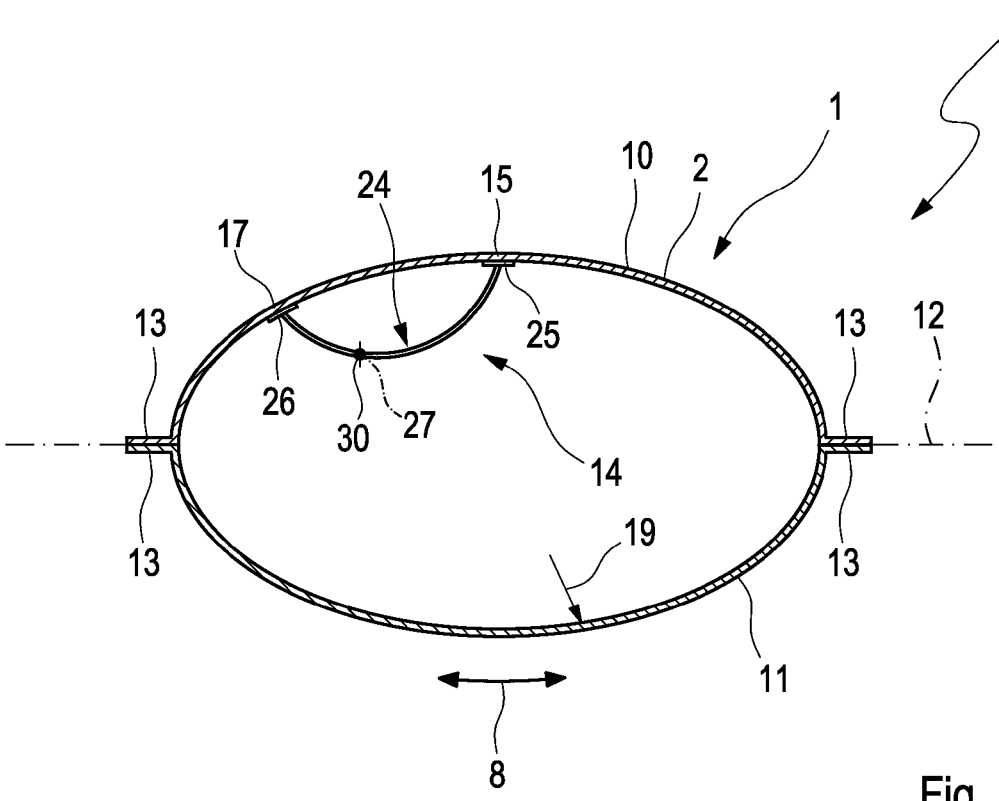

The assembly of the housing 2 is explained in more detail by means of FIGS. 8*a* and 8*b:*

Initially, the one (second) half-shell 11 is fitted with all components of the housing 1 located inside and—depending on design—with the end bottoms 3, 4. Following this, the other (first) half-shell 10 is attached. While attaching the other (first) half-shell 10, the latter, according to FIG. 8, initially comes to bear against the second support contour 26 of the lever 24 in the second supporting region 17, so that this (first) half-shell 10 upon further approximation of the other (second) half-shell 11 introduces a force onto the lever 24. Delayed, the first supporting region 15 then also comes in contact with the first supporting contour 25 of the lever 24, as a result of which upon further approximation of the two half-shells 10, 11 to each other, the preloads are then established in the lever 24. FIG. 8*b* shows the state upon completed approximation of the two half-shells 10, 11.

The invention claimed is:

1. A housing, comprising:

a jacket enclosing a housing interior space in circumferential direction; and at least one preloading device which is arranged in the housing interior space, which supports itself on a first supporting region of the jacket on the inside on the jacket subject to a first preload orientated towards the outside and which supports itself on a second supporting region of the jacket spaced from the first supporting region on the jacket on the inside subject to a second preload oriented towards the outside;

wherein the housing interior space transversely to the axial direction has a round, flattened cross section, so that a curvature radius of the jacket varies in the circumferential direction, wherein the two supporting regions in circumferential regions are arranged with different curvature radii; and wherein the second supporting region is arranged in a second circumferential region which has a smaller curvature radius than a first circumferential region, in which the first supporting region is arranged.

2. A housing, comprising:

a jacket enclosing a housing interior space in circumferential direction; and at least one preloading device which is arranged in the housing interior space, which supports itself on a first supporting region of the jacket on the inside on the jacket subject to a first preload orientated towards the outside and which supports itself on a second supporting region of the jacket spaced from the first supporting region on the jacket on the inside subject to a second preload oriented towards the outside;

wherein the housing interior space transversely to the axial direction has a round, flattened cross section, so that a curvature radius of the jacket varies in the circumferential direction, wherein the two supporting regions in circumferential regions are arranged with different curvature radii; and the two supporting regions in the circumferential direction are spaced from each other by at least 30° and by a maximum of 90° and preferentially by approximately 45°.

3. A housing, comprising:

a jacket enclosing a housing interior space in circumferential direction; and at least one preloading device which is arranged in the housing interior space, which supports itself on a first supporting region of the jacket on the inside on the jacket subject to a first preload orientated towards the outside and which supports itself on a second supporting region of the jacket spaced from the first supporting region on the jacket on the inside subject to a second preload oriented towards the outside; and wherein the jacket is configured in one of wrap design or in tubular design or in half-shell design, and wherein second supporting region with a jacket is configured in half-shell design and is arranged proximally to a separating plane, in which the two half-shells are fastened to each other, while the first supporting region is arranged distally to the separating plane.

4. A housing, comprising:

a jacket enclosing a housing interior space in circumferential direction; and at least one preloading device which is arranged in the housing interior space, which supports itself on a first supporting region of the jacket on the inside on the jacket subject to a first preload orientated towards the outside and which supports itself on a second supporting region of the jacket spaced from the first supporting region on the jacket on the inside subject to a second preload oriented towards the outside; and wherein the respective preloading device comprises at least one lever, which comprises two supporting contours spaced from each other, which in each case support themselves in one of the supporting regions on the jacket on the inside, wherein a rotary axis of the lever is positioned between the supporting contours so that lever arms that are different in magnitude are obtained for the supporting contours.

5. The housing according to claim 4, wherein the respective lever is pivotably arranged about the rotary axis on an end bottom axially limiting the housing interior space or on an intermediate bottom arranged in the housing interior space, particularly axially between two end bottoms, wherein more preferably the respective lever is mounted in a rotatably adjustable manner about the rotary axis on the respective bottom or in a manner capable of rolling-off about the rotary axis.

6. The housing according to claim 4, wherein the respective preloading device comprises a preloading structure arranged in the housing interior space, particularly between the end bottoms, which comprises a plurality of such levers which are arranged distributed in the circumferential direction.

7. The housing according to claim 4 wherein at least one of the support contours of the respective lever is formed on a support body, which is moveably arranged on the respective lever.

8. The housing according to claim 7 wherein the same support body is at least one of preloaded against the jacket via plurality of levers, and the support body has a convex outer contour facing the jacket, which is shaped complementarily to the concave inner contour of the respective supporting region of the jacket.

* * * * *